US008415285B2

(12) United States Patent
Develter et al.

(10) Patent No.: US 8,415,285 B2
(45) Date of Patent: Apr. 9, 2013

(54) COMPOSITION FOR THE PREVENTION OR REMOVAL OF INSOLUBLE SALT DEPOSITS

(75) Inventors: Dirk Willem Godfried Develter, Maldegem (BE); Luc Marc Leonie Lauryssen, Zoersel (BE)

(73) Assignee: Ecover Coordination Center N.V., Antwerp (BE)

( * ) Notice: Subject to any disclaimer, the term of this patent is extended or adjusted under 35 U.S.C. 154(b) by 0 days.

(21) Appl. No.: 13/575,474

(22) PCT Filed: Jan. 31, 2011

(86) PCT No.: PCT/EP2011/051303
§ 371 (c)(1),
(2), (4) Date: Aug. 14, 2012

(87) PCT Pub. No.: WO2011/092325
PCT Pub. Date: Aug. 4, 2011

(65) Prior Publication Data

US 2012/0302484 A1 Nov. 29, 2012

(30) Foreign Application Priority Data

Jan. 29, 2010 (EP) ..... 10152175

(51) Int. Cl.
*C11D 17/00* (2006.01)

(52) U.S. Cl.
USPC ..... 510/191; 510/192; 510/247; 510/253; 510/447; 510/477

(58) Field of Classification Search ..... None
See application file for complete search history.

(56) References Cited

U.S. PATENT DOCUMENTS

| | | | | |
|---|---|---|---|---|
| 2,422,255 | A | 6/1947 | Peters | |
| 3,998,762 | A | 12/1976 | Murata et al. | |
| 4,210,550 | A | 7/1980 | Cornelissens | |
| 4,820,449 | A | 4/1989 | Menke et al. | |
| 5,151,208 | A | 9/1992 | Huijben et al. | |
| 5,192,460 | A | 3/1993 | Thomas et al. | |
| 5,260,456 | A | 11/1993 | Alas et al. | |
| 5,472,629 | A | 12/1995 | Lysy et al. | |
| 8,092,613 | B2 * | 1/2012 | Strothoff et al. | 134/25.2 |
| 2007/0191245 | A1 | 8/2007 | Klein et al. | |

FOREIGN PATENT DOCUMENTS

| | | |
|---|---|---|
| EP | 0 242 141 | 10/1987 |
| EP | 0 619 366 | 10/1994 |
| GB | 1 427 710 | 3/1976 |
| JP | 07-126698 | 5/1995 |

OTHER PUBLICATIONS

International Search Report dated Aug. 5, 2011 issued to international priority application No. PCT/EP2011/051303.
Database WPI, May 16, 1995, JP 7-126698, AN 1995-213301, 2 pages.
Magnuson, et al. "Organic Acid Production by Filamentous Fungi," *Advances in Fungal Biotechnology for Industry, Agriculture, and Medicine*, Kluwer Academic/Plenum Publishers, pp. 307-340, 2004.

* cited by examiner

*Primary Examiner* — Necholus Ogden, Jr.
(74) *Attorney, Agent, or Firm* — Knobbe, Martens, Olson & Bear LLP

(57) ABSTRACT

The present invention provides compositions, in particular blocks, tablets and gels, for the prevention or removal of insoluble salt deposits comprising: a) an organic acid with two carboxylic acid functional groups obtainable by fermentation, selected from the list of itaconic acid, itaconic acid anhydride, succinic acid, succinic anhydride and combinations thereof, and b) at least one compound determining the release of said acid from said composition, said compound is selected from a list comprising: i) a hygroscopic compound, ii) a carbonate source, iii) an acid solubility retarding compound, iv) a compound with melting point situated between 60° C.-95° C., and combinations thereof. The invention further provides uses of the compositions for the prevention or removal of insoluble salt deposits. The invention also provides a method of manufacturing such compositions and a method for the prevention or removal of insoluble salt deposits with a product of the invention.

19 Claims, No Drawings

COMPOSITION FOR THE PREVENTION OR REMOVAL OF INSOLUBLE SALT DEPOSITS

CROSS-REFERENCE TO RELATED APPLICATIONS

This application is the U.S. National Phase under 35 U.S.C. §371 of International Application PCT/EP2011/051303, filed Jan. 31, 2011, which claims priority to EP 10152175.5, filed Jan. 29, 2010.

TECHNICAL FIELD

The present invention relates to compositions for the prevention or removal of insoluble salt deposits. The present invention further relates to use of compositions for the prevention or removal of insoluble salt deposits. The present invention further provides a method for the manufacturing of compositions for the prevention or removal of insoluble salt deposits and to a method to prevent or remove insoluble salt deposits using compositions according to the invention.

The present invention relates to the use of a composition comprising itaconic acid, its anhydride, succinic acid, its anhydride, and or lactide and combinations thereof for the prevention or removal of insoluble salt deposits.

The present invention further relates to a toilet block, comprising a composition comprising itaconic acid, its anhydride, succinic acid, its anhydride, and or lactide and combinations thereof.

The present invention further relates to an effervescent tablet comprising a composition comprising itaconic acid, its anhydride, succinic acid, its anhydride, and or lactide and combinations thereof.

The present invention further relates to an acid gel comprising a composition comprising itaconic acid and or succinic acid combined with a rheology modifier.

Also, this invention relates to a composition comprising itaconic acid, its anhydride, succinic acid, its anhydride, and or lactide and combinations thereof for the prevention or removal of insoluble salt deposits

BACKGROUND

Water insoluble salts such as calcium and magnesium carbonates or silicates or sulfates commonly referred to as limescale, but also barium sulfate, calcium oxalate, calcium phosphate, iron oxide and the like are readily formed in watery solutions when the conditions are right and may each represent particular challenges in relation to their removal.

Limescale or limestone is the hard, off-white, chalky deposit found in kettles, hot-water boilers and the inside of inadequately maintained hot-water central heating systems. It is also often found as a similar deposit on the inner surface of old pipes and other surfaces where "hard water" has evaporated.

These types of limescale differ slightly due to their origins. The type found deposited on the heating elements of water heaters, laundry machines, etc. has a main component of calcium carbonate, precipitated out of the (hot) water. Hard water contains calcium (and often magnesium) bicarbonate and/or similar salts.

Calcium bicarbonate is soluble in water, however at temperatures above 70° C. the soluble bicarbonate is converted to poorly-soluble carbonate, leading to deposits in places where water is heated. Local boiling "hot spots" can also occur when water is heated, resulting in the concentration and deposition of salts from the water. Likewise calcium sulfate is a common component of fouling deposits in industrial heat exchangers, due to its decreased solubility with increasing temperature. Silicate containing laundry and automatic dishwashing products may cause a calcium or magnesium silicate deposit, which is especially difficult to remove (in contrast to calcium carbonate) from glassware.

The type found on air-dried cooking utensils, dripping taps and bathroom tiling consists of calcium carbonate mixed with all the other salts that had been dissolved in the water, prior to evaporation. It can also be found on taps and water reservoirs (such as in the toilet) where hard water has been continually running through and has deposited calcium carbonate.

The presence of limescale presents several problems. Other than being unsightly and harder to clean, limescale can impair the operation of various components or damage them. In kettles, limescale acts as an insulator, impairing heat transfer. Additionally, it can damage the heating element, which overheats due to accruing limescale. Limescale can build up inside tubing, thus reducing water flow and necessitating higher electrical consumption for the circulation pumps, and eventually blocking the tubing. Expresso machine manufacturers recommend to descale the machine (depending on the water hardness) every month or trimester in order to avoid bitter taste development, machine malfunction and slowing down.

Other types of deposits formed by insoluble salts are beerstone and milkstone. Calcium oxalate forms a major component of beerstone, a brownish precipitate that tends to accumulate within vats, barrels and other containers used in the brewing of beer. Beerstone is composed of calcium and magnesium salts and various organic compounds left over from the brewing process; it promotes the growth of unwanted microorganisms that can adversely affect or even ruin the flavor of a batch of beer. Calcium oxalate is also formed during carbonation of raw sugar beet juice before it undergoes crystallization. First, the juice is mixed with hot milk of lime (a suspension of calcium hydroxide in water). This treatment precipitates a number of impurities, including multivalent anions such as sulfate, phosphate, citrate and oxalate, which precipitate as their calcium salts and large organic molecules such as proteins, saponins and pectins, which aggregate in the presence of multivalent cations.

Milkstone is a layer of scale mainly formed by cations like calcium and magnesium originating from both milk and hard water. Besides giving the equipment an unclean appearance, milkstone could harbour and protect micro organisms always present in raw milk and ready to multiply at a high rate. Since milk products are some of the most perishable major foods, cleaning and sanitization in that industry generally require the highest standards. The main part of milk residu is easily removed by rinsing with water. However, the last part comprising the milkstone is often harder to get rid of.

Several methods and products have been developed in order to remove some or all of these different types of deposits by insoluble salts, such as limescale.

Generally, different types of descaling agents are used to remove deposits by insoluble salts. Descaling agents are either acids or complexing agents or both in one (e.g. carboxylic acids). They remove insoluble deposits such as limescale by respectively dissolving the limescale and or complexing its cationic constituents. Acids used as descaling agents can be either mineral acids or organic acids. Below in table 1, the properties of some organic and mineral acids that are used or can be potentially useful for descaling are shown.

TABLE 1

Properties of some organic and mineral acids used or potentially useful for descaling.

| Trivial name of acid | Solubility water 20° C. | Solubility calcium salt g/100 ml | physical form | Sourcing | descaling | pKa | smell | Compatibility | label |
|---|---|---|---|---|---|---|---|---|---|
| oxalic | 14% | 0.0007 | powder | Petro | | 1.3/4.3 | ++ | | C, Xn |
| maleic | >40% | 2.9 | powder | Petro | | 1.9/6.3 | +− | | Xi/Xn |
| malonic | >90% | No data | powder | Petro | | 2.9/5.7 | +− | | Xn |
| tartaric | +−60% | 0.04 | powder | Ferm | | 3/4.3 | ++ | | Xi |
| fumaric | 64% | 1.4, 2%[b] | powder | Petro | | 3/4.4 | ++ | | Xi |
| citric | 60% | 5% (1.Ca) 0.09% (2-3.Ca) | powder | Ferm | − | 3.1/4.8/6.4 | ++ | ++ | Xi |
| malic | >80% | 0.8%[b] | powder | Petro | + | 3.4/5.1 | +− | −− | Xn |
| formic | 100% | 17 | liquid | Petro | ++ | 3.8 | −− | −− | C, Xn |
| glycolic | 100% | 1.2% | powder | Petro | −− | 3.9 | +− | −− | C, Xn |
| itaconic | 9.5% | No data | powder | Ferm | | 3.9/5.1 | ++ | | Xi |
| lactic | 100% | 7%, 3.1%[b] | liquid | Ferm | + | 3.8 | ++ | ++ | Xi |
| gluconic | >50% | 3, 3%[b] | powder | Ferm | | 3.9 | −− | | Xn |
| succinic | 7.7% | 0.004%[b] | powder | petro/ferm | | 4.2/5.6 | ++ | | C, Xn |
| glutaric | 50% | Soluble | powder | Petro | | 4.3/5.4 | ++ | | Xi |
| Acetic | 100% | 33.8 | liquid | petro/ferm | + | 4.8 | −− | −− | C, Xn |
| Lactide[a] | Insol.[a] | [a] | Powder | Ferm | | / | ++ | ++ | Xi |
| phosphoric | 100% | 0.03 | liquid | Min | ++ | 2.2/6.8/12.4 | + | − | C, Xn |
| sulfamic | 29% | No data | powder | Min | ++ | 0.1 | +− | +− | C, Xn, N |
| hydrochloric | >40% | 75 | liquid | Min | | −9.3 | −− | | C, T, N |
| sulfuric | 100% | 0.3 | liquid | Min | | −3 | +− | | C, T |

[b]Lactide is a dimeric ester rather than an acid but readily hydrolyses to lactic acid. Data obtained from presentations by Purac and complemented with various literature data. Properties listed include the solubility in water (pH 7, 20° C.), the solubility of the calcium salt (mono, di, tri-salts, [b]as % anhydrous at 25° C.), their physical form, descaling effectiveness (Purac data), pKa value(s), smell, overall material compatibility (Purac data) and labeling according to EU legislation.

Table 1 documents among other characteristics the water solubility of di- and tri-salts of polybasic carboxylic acids which tends to be (very) limited as compared to that of monocarboxylic acids, with maleic and glutaric acids as an exception to this apparent rule. No literature data were found regarding the calcium salt of itaconic acid. Whereas the monocalcium salt of citric acid is water soluble (5%), the disalt and trisalts are only sparingly or practically insoluble (0.09 g/l).

The majority of acids commercially used for descaling are mineral acids such as phosphoric, sulfamic, hydrochloric and sulfuric acid (cf table 1). These are however classified as corrosive to the skin and the eyes and as environmentally hazardous or in case of phosphoric acid represent a substantial eutrophication potential. Moreover they tend to be either fuming or cause a pungent smell and their overall material compatibility is limited.

Organic acids have one, two or three carboxyl groups (note the pKa values in table 1) and are usually less aggressive which is why acetic, citric and formic and more recently glycolic and lactic acid found their way to the market.

Organic acids can be sourced from fermentation or from petrochemical synthesis. Citric and lactic acid for example are obtained by fermentation from renewable feedstock (typically molasses). The fact that many of these organic acids suitable for descaling action are renewable is increasingly considered an environmental advantage as illustrated in life cycle analyses. However, some of these organic acids still show disadvantages.

For example, the iron and calcium salts of citric acid are said to be less soluble than those of glycolic acid, so they may precipitate onto the treated surfaces, diminishing cleaning effectiveness of citric acid.

Acetic and formic acid have a pungent smell that is hard to cover with fragrance, which is a serious disadvantage.

Acetic acid, which may be sourced from fermentation or from petrochemical synthesis, is renowned for its corrosivity to copper which leads to the formation of toxic copper acetate (a fungicide) thus rendering acetic and vinegar unsuited for descaling coffee and expresso machines which often have a copper mounting tube for hot water or steam. Acetic acids will thus also be unsuited for all other surfaces comprising cupper.

Furthermore, the descaling activity of many organic acids is quite weak. Many organic acids either show efficiency in fast descaling or in descaling upon prolonged contact, but not both. Moreover a limited number of organic acids is available as a solid. These are huge disadvantages as they put a restriction onto the development of descaling agents that offer an overall better efficiency.

There is a need for a descaling agent which is renewable, and which shows a better efficiency than the existing products.

One specific application of descaling agents is their use in toilet blocks, since toilets often suffer from severe insoluble salt deposits. Traditionally toilet blocks in the past where designed to mask odors and have a slight cleaning effect in the toilet. The two main types manufactured and marketed up until the late 1980's were the so called rim and the in-cistern blocks, applied in the toilet bowl and the water cistern respectively. During the 1990's several new developments have been marketed, with the liquid rim containers coming on the market which has greatly increased the flexibility and number of ingredients available to formulate with, and the solid block formulations have also been expanded with products that have special properties (i.e. lime scale inhibition, bleaching, cleaning efficiency, etc.).

There are different challenges to the formulation and manufacture of toilet and cistern blocks as these are dependent on most of the ingredients being supplied as practically water free chemicals, otherwise they might have a negative influence on the chemical properties of the block as well as the stability and compatibility with other ingredients included. The main manufacturing process for such blocks is by extrusion of a pre-made dry mixture of all the ingredients. A crucial property for the manufacture of solid blocks however has been the extrusion properties of the anionic surfactants and in particular dry LAS (Linear Alkyl Benzene sulfonate). The sodium salt of LAS in dry form is available as a very hygroscopic powder, which means that precaution has to be taken in terms of handling and storage, but it is also this product characteristic that makes it an excellent main ingredient in formulating solid extrude toilet blocks. The hygroscopic nature of LAS ensures that once the final product is exposed to water in the toilet bowl or in the cistern it will create an outer layer or membrane that slows down the overall solubility of the block thereby imparting a controlled release of all the active ingredients in the block (source: Toilet block introductory Leaflet by Unger, 2008). Formulating rim and in-cistern blocks among others implies selecting solubility retarding or "matrix" ingredients with a melting point at or just above the extrusion temperature, which upon cooling will form a homogenous solid block that will gradually and evenly set free its actives over time, typically during several weeks for 50 to several hundreds of flushes, more typically up to 500-800 flushes. Such formulas contain 25-50% LAS (typically 40%), 0-8% fatty alcohol sulfate (mainly $C_{12-14}$, some $C_{16}$ in cistern blocks) or 0-5% highly ethoxylated fatty alcohol (e.g. $C_{16-18}$ with up to 50 mol ethylene oxide), 0-3.5% Coconut monoethanolamide, 1% foam enhancing fatty alcohol ether sulfate, 0.05% paraffin oil, 5-6% fragrance and dyes and sodium sulfate as a filler. Low amounts of acids (e.g. 2% lactic acid or 10-20% citric acid anhydrate) have been incorporated as well as polymers. US2007191245A1 for example describes the use in toilet blocks of polysuccinimide for preventing or dispersing urine scale.

Effervescent toilet descaling tablets form an alternative approach for descaling, targeting fast tablet disintegration (as opposed to toilet blocks) but long contact times (e.g. overnight). They are produced by tabletting and always contain an acid (usually sulfamic or citric acid) for dissolution of the immersed limescale and a carbonate source for the effervescent system (sodium carbonate, bicarbonate, percarbonate, . . . ). Formulating such tablets is all about finding the balance between fast dissolution on one hand and tablet strength and stability on the other. Low moisture content is of paramount importance, especially when the formula contains percarbonate bleach. A typical formula contains 1-2% lauryl sulfoacetate or FAS, 1% FAEO $C_{16-18}$ 8EO, 40-50% citric or sulfamic acid, 20-30% sodium carbonate, some polyethylene glycols, fragrance, dye, and sulfate as a filler. Some formulations additionally contain about 2% percarbonate bleach.

Products dedicated to periodical cleaning and descaling of automatic dishwashing machines usually are based on citric acid and a small amounts of FAEO (e.g. $C_{9-11}$, 4EO), and additionally may contain some corrosion inhibitor, solvents, PEG, phosphonates, fragrance and dye.

There is a need for a renewable low moisture and stabile descaling agent that can be used in descaling block or tablet formulations and has a better efficiency than the existing descaling agents used in toilet blocks and tabs.

It is an object of the present invention to provide a new descaling agent which is made of renewable material and which shows a better overall efficiency than the descaling agents known from the prior art.

It is also an object of the present invention to find a toilet block comprising a descaling agent, which is made of renewable material, is low moisture and stabile with a better efficiency than the existing descaling agents used in toilet blocks.

SUMMARY OF THE INVENTION

The present invention aims to provide a solution for at least one of the problems mentioned.

The first object is achieved by a composition of claim 1. In particular, the present invention provides a composition for the prevention or removal of insoluble salt deposits comprising:

a) an organic acid with two carboxylic acid functional groups obtainable by fermentation, selected from the list of itaconic acid, itaconic acid anhydride, succinic acid, succinic anhydride and combinations thereof, and b) at least one compound determining the release of said acid from said composition, said compound is selected from the list comprising:

i) a hygroscopic compound, ii) a carbonate source, iii) an acid solubility retarding compound, iv) a compound with melting point situated between 60° C.-95° C., and combinations thereof.

The inventors found that an acid as described under a) could be combined with compounds acting as acid release regulating means as described under b). This is advantageous as it allows the manufacturing of compositions for both fast and slow release based an acid of renewable resources, in particular itaconic acid and/or succinic acid.

In a preferred embodiment, the anhydride form is used. The acids and anhydrides prescribed are interesting from an ecological point of view as they are readily degradable and obtainable from renewable resources. The acids are remarkably compatible with the functional compounds under b). The combination of a) and b) provides a synergistic effect. The acids under a) do not impact the functionality of compounds under b). This has for effect that they can be used as mixing partners. Selections of a compound from the list under b) will provide access to compositions with either slow or fast release of the acid under b). Both fast and slow release compositions for itaconic acid, itaconic acid anhydride, succinic acid, succinic acid anhydride have become available.

In a preferred embodiment, the organic acid is itaconic acid.

Itaconic Acid ($CH_2$:C(COOH)$CH_2$COOH, CAS 97-65-4, also called Methylene Succinic Acid, Butanedioic acid, Methylene Butanedioic acid, Propylenedicarboxylic acid; 2-Propene-1,2-dicarboxylic acid;) is a white anhydrous (<0.3%) hygroscopic crystalline dicarboxylic acid with a melting point of 166° C. It is soluble in water, ethanol and acetone. Its chemical structure is similar to that of succinic acid but with a methylene group substituted onto the carbon chain, the unsaturated double bond forming a conjugated system with the carbonyl group.

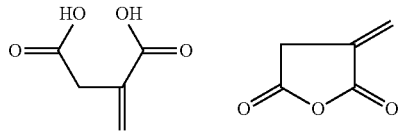

Itaconic can be converted into its anhydride as described in U.S. Pat. No. 5,260,456. Itaconic anhydride (CAS 2170-03-8,2-Methylenesuccinic anhydride) white crystals have a slightly acidic odor and a melting point of 67-69° C. In contact with water the anhydride will hydrolyze back to itaconic acid.

Itaconic acids primary application is in the polymer industry where it is employed as a co-monomer at a level of 1-5% in styrene butadiene resins and in acrylic latexes for textile, paper, and paint applications. It is furthermore used to prepare acrylic fibers and rubbers, reinforced glass fiber, artificial diamonds and lens.

Itaconic acid was discovered as a distillation product of citric acid, but is now typically produced in a fungal fermentation at relatively small scale. Magnuson and Lasure (2004) give an extensive overview of the history and current status of itaconic acid. The first reported biological source of itaconic acid was the descriptively named *Aspergillus itaconicus*. Shortly thereafter, it was discovered that *A. terreus* produced itaconic acid. An efficient process for the fermentation of sucrose in molasses to itaconic acid using *A. terreus* was patented in 1962. The reported yield is 70%, Magnuson J K, and L L Lasure. 2004. "Organic Acid Production by Filamentous Fungi." Chapter 12 in ADVANCES IN FUNGAL BIOTECHNOLOGY FOR INDUSTRY, AGRICULTURE, AND MEDICINE, ed. Jan S. Tkacz and Lene Lange, pp. 307-340. Kluwer Academic/Plenum Publishers, New York, N.Y.

The inventors have surprisingly found that itaconic acid in a composition according to an embodiment of the invention shows excellent descaling activity and an overall excellent activity in the removal and prevention of insoluble salt deposits.

Furthermore, itaconic acid in a composition according to an embodiment of the invention is a very strong descaling agent in both fast descaling as well as descaling upon prolonged contact.

Furthermore, It can be produced through fermentation, and it is a fully renewable descaling agent. Furthermore, it is non-corrosive and has a neutral smell.

Furthermore, itaconic acid can be used as a solid state, stabile, low moisture ingredient for descaling activities, allowing polyvalent use.

Furthermore itaconic anhydride can be used as an agent releasing the above itaconic acid upon contact with water, a property especially useful in toilet blocks.

In a preferred embodiment, the compound selected from list b) is the hygroscopic compound. More preferably, the hygroscopic compound is lactide, an anionic surfactant, or combinations thereof. In a preferred embodiment the hygroscopic compound is lactide. An example of a hygroscopic anionic surfactant is alkyl benzene sulfonate. In a preferred form, itaconic acid is in substantially dry form, i.e. with a water content of at most 5%, preferably at most 3%, more preferably at most 1%, most preferably at most 0.5%.

Lactide (CAS 4511-42-6 and 95-96-5, also called cyclic dimer of lactic acid, Dilactide, L-Lactide, DL-Lactide, 3,6-Dimethyl-1,4-dioxane-2,5-dione) on the other hand contains two molecules of natural L(+)-lactic acid in the form of a ring. While mixed with water, the ring is hydrolyzed back into two free L(+)-lactic acid molecules that allow a delayed acidification of the medium, the pH drop to pH2 being completed after two hours. The inventor observed complete dissolution at room temperature to require at least 3 hours while stirring. The strong acidity released by lactide is due to the low pKa of lactic acid and to the release of two acidic functions per mole. It is a white, almost odorless, virtually water-free (<30 ppm) very hygroscopic powder with a melting point of 94-99° C.

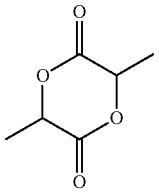

Lactide is produced by double condensation of L(+)-lactic acid molecules obtained by fermentation of natural sugar. After several solvent-free purification steps, small white flakes of pure 3,6-dimethyl-1,4-dioxane-2,5-dione are obtained (solid lactic acid). There are several methods to prepare lactic acid. Among the biological routes is a process employing *R. oryzae*. The organism imports glucose and exports lactate, an acid that is not a component or by-product of the citric acid cycle. Lactate is produced by the organism aerobically, and the commercial process requires agitation and aeration just as the other fungal organic acid processes do. The substrate for the *R. oryzae* process is glucose, and the manufacturers are corn-processing companies with readily available low-cost glucose. Lactic acid is recovered by the technologies used for the other organic acids, including precipitation from an alcoholic extract. In aqueous solution, lactic acid dimerizes to form lactide, an intermediate for the biodegradable plastic, polylactic acid (PLA). Until recently, lactic acid was used primarily in the food industry as a preservative, flavor enhancer, and acidulant. The dedicated Nebraskan PLA ("NatureWorks") production site alone has a production capacity of 140.000 tons and PLA use in packaging is currently rapidly growing.

The inventor has surprisingly found that also lactide shows excellent descaling activity and an overall excellent activity in the removal and prevention of insoluble salt deposits.

In a preferred embodiment, a composition according to the invention comprises 1-20% lactide, preferably 1-20% slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

Furthermore, It can be produced through fermentation, and it is a fully renewable descaling agent.

Furthermore, it is also non-corrosive and has a neutral smell and can be used as a solid state, stabile, low moisture ingredient for descaling activities, allowing polyvalent use.

Lactide and Itaconic acid or its anhydride can be used separately as a descaling agent but they also show a highly efficient descaling activity when used in combination with each other.

Preferably, the insoluble salts deposits are selected from a group consisting of lime scale, beer stone, milk stone, barium sulfate, calcium oxalate and combination thereof.

Preferably, itaconic acid, its anhydride and or lactide and combinations there is present in the composition in a concentration of 5-60% m/m, preferably 20-40% m/m.

In such a concentration range, the composition of the present invention, is most effective.

In a preferred embodiment, the composition further comprises one or more other acids.

Combined with other acids, the composition comprising lactide, itaconic acid and/or anhydride can be even more efficient.

In a preferred embodiment, the compound selected from list b) is the carbonate source. More preferably, the carbonate source is sodium carbonate, bicarbonate or percarbonate.

In a preferred embodiment, the compound selected from list b) is the acid solubility retarding compound. More preferably, the acid solubility retarding compound is an ethoxylated surfactant with C16-C22 carbon chain length and an ethoxylation degree of 30-40 ethylene oxide groups, a thickener, or combinations thereof.

Suitable thickeners for use in the above described invention may be of synthetic or biobased, preferably biobased. A suitable synthetic thickener, is for example a polyacrylate. Suitable biobased thickeners are for instance hydrocolloids such as pectin, agar, carrageenan, alginate, starch, locust bean gum, gelatin, guar gum, gum Arabic, xanthan gum, 12-hydroxy stearic acid. Derivatives of the previously listed compounds may also be used. They include carboxymethylcellulose, carboxymethyl guar gum. Evidently, combinations of the thickeners listed above may also be used.

In a preferred embodiment, the compound selected from list b) is the compound with melting point between 60° C.-95° C.; preferably between 60°-90° C., more preferably between 60°-80° C., most preferably between 60°-75° C. Preferably the compound iv) is a nonionic sucrose ester with melting point between 60° C.-75° C. In another preferred embodiment, compound iv) is a lactide with melting point of approximately 95° C., or combinations thereof.

In a preferred embodiment, a composition of the invention has a reduced level of alkyl benzene sulfonate. More preferably, the composition is free of alkyl benzene sulfonate. The inventors found that fatty alcohol sulfate is a good substitute for at least part or all of the alkyl benzene sulfonate. In a preferred embodiment of the invention, at least part or all of the alkyl benzene sulfonate in the composition is replaced by fatty alcohol sulfate. The reduction of the use of alkyl benzene sulfonate is advantageous as alkyl benzene sulfonate is a petrochemical which upon aerobic biodegradation leaves stable metabolites and is not degradable in anaerobic conditions. The use of fatty alcohol sulfate in a composition of the invention is advantageous as it has a better ecological profile than alkyl benzene sulfonate. It provides good foam. Foam functions as an indicator to a consumer that the composition is working. The inventors also found that the extrudability of a composition according to the invention comprising a fatty alcohol sulfate is improved.

In a preferred embodiment, a composition of the invention comprises lactide, preferably slow-release lactide. The lactide will liberate lactic acid which will further enhance the lime scale removal claimed in/subject to this invention. Lactic acid is released from a slow-release lactide as follows. A 0.1 w/v % solution of the slow-release lactide in demineralized water at 25° C. is characterized by a curve depicting pH versus time, wherein the pH is 3.7 after 5 minutes, the pH is 3.2 after 10 minutes, and the pH is 2.5 after 120 minutes. Slow-release lactide is commercially available from the company Galactic, Belgium. Use of slow-release lactide is advantageous as it has the effect that the release of acid from a composition, i.e. lactide and other acids present, for the prevention or removal of insoluble salt deposits can be tuned further.

In a preferred embodiment, the composition is formulated as a virtually water-free powder, tablet or block.

In such a formulation, the solid state acids used in the present invention allow prolonged exposure either due to the product form or through delayed acidification. This makes the composition very suitable for applications such as toilet blocks.

The invention further provides several type compositions for use in the prevention or removal of insoluble salt deposits, including toilet rim, cistern or urinal block; tablets and gels.

In a preferred embodiment, the composition is a toilet rim, cistern or urinal block, comprising: 3-30 weight % itaconic acid, itaconic anhydride, succinic acid, succinic anhydride or a combination thereof, 20-50 weight % linear alkyl benzene sulfonate and/or fatty alcohol sulfate, and the remainder formulation auxiliaries. Preferably the formulation auxiliaries comprise or consist of a perfume or fragrance.

In a more preferred embodiment, the toilet rim, cistern or urinal block as previously described comprises an acid solubility retarding sucrose derivative. In a preferred embodiment, the solubility retarding sucrose derivative is a sucrose behenate, sucrose stearate and/or a fatty acid derived sucrose ester with melting point between 60° C.-75° C. The latter is commercially available from P&G, under the trade name Sefose. Use of a sugar based compound in a formulation according to the invention has for effect that the amount of compounds derived from renewable resources is increased further. Sugar based molecules provide an improve degradability. The degree of biobased materials used is increased even further.

In a preferred embodiment, the blocks as described above have a life expectancy of at least 50 flushes, preferably at least 100 flushes, most preferably at least 200 flushes.

To a person skilled in the art tests are available for determining the life expectancy characterizing a batch of products. A test can be carried out as follows: A product is weighed. It is set in a toilet near the water supply means, at a precisely defined place. The toilet is fed with 35° THF hard water reproducing unfavorable but realistic conditions. The toilet is flushed at irregular time intervals. The test is carried out until the product is completely consumed. From the number of flushes required to consume the product, the product life expectancy is obtained. The life expectancy can be expressed in number of flushes, number of days or number of weeks.

In another preferred embodiment of the invention, the composition as previously described is provided in the form of an effervescent tablet. In particular, the effervescent tablet comprises: 7-75% itaconic acid, itaconic anhydride, succinic acid, succinic anhydride or a combination thereof, 5-25% of a carbonate source, selected from the list of sodium carbonate, bicarbonate, percarbonate and combinations thereof, and the remainder formulation auxiliaries. Preferably the formulation auxiliaries comprise or consist of a perfume or fragrance.

In a preferred embodiment of the invention, a 20 gram tablet dissolves in one liter of water in under 15 minutes and the pH of the resulting water comprising the dissolved table is at most 4.5, preferably at most 4.0, more preferably at most 3.5. Preferably the pH-development provided by the tablet does not go below 2.0.

In another preferred embodiment of the invention, the composition as previously described is provided in the form of a toilet gel. In particular, the toilet gel, comprises: 1-30% itaconic acid, succinic acid, or a combination thereof, 2-40% an ethoxylated nonionic surfactant with an ethoxylation degree of 30-40 ethylene oxide units, a thickener such as a polyacrylate, a hydrocolloid, a derivative of a hydrocolloid, or a combination thereof, and the remainder formulation auxiliaries. Preferably the formulation auxiliaries comprise or consist of a perfume or fragrance.

In a further aspect of the invention uses for the compositions of the invention are provided. In a preferred embodiment, a composition according to an embodiment of the invention is used for the prevention or removal of lime scale, beer stone, milk stone, barium sulfate, calcium oxalate and combinations thereof.

Preferably the used described previously is one wherein the prevention or removal is directed to a toilet, a laundry machine, a dishwashing machine, a boiler, a kettle, a coffee-maker, an espresso machine, a dairy equipment, a food processing equipment, a beverage processing equipment, an industrial water system, or a well.

In another preferred embodiment of the present invention, the composition described here above, is used the removal of insoluble salt deposits upon prolonged exposure of the insoluble salts to the composition.

The invention is however not limited to prolonged exposure of the composition, all other types of exposure known by the person skilled in the art, can also be used. The composition according to the present invention is for example also very effective in fast descaling. If however the composition is applied during prolonged exposure, it is very effective for heavy duty removal of thick deposits of insolubles, which is an advantage.

In a third aspect of the invention, a method for the manufacturing of compositions according to the invention is provided. In a preferred embodiment, a method for manufacturing compositions for the prevention or removal of insoluble salt deposits comprises the step of:

selecting an organic acid with two carboxylic acid functional groups obtainable by fermentation and available in substantially dry powder form, from itaconic acid, itaconic acid anhydride, succinic acid, succinic anhydride or a combination thereof, mixing the selected organic acid with at least one compound determining the release of said acid from said composition, said compound is selected from a list comprising: i) a hygroscopic compound, ii) a carbonate source, iii) an acid solubility retarding compound, iv) a compound with melting point situated between 60° C.-95° C., and combinations thereof, -extruding or melt casting the mixture obtained at a temperature between 60° C.-95° C., obtaining the composition for the prevention or removal of insoluble salt deposits in a desirable form such as a block, tablet or gel.

In a final aspect, the invention provides a method for the prevention or removal of insoluble salt deposits comprising the step of:

connecting a composition according to an embodiment of the invention to a supply means of water, contacting the composition with water from said supply means thereby lowering the pH of the water to a pH below 5, leading the water with pH below 5 over a surface in need of treatment, thereby preventing insoluble salts to deposit on the surface or thereby removing from the surface insoluble salts deposited on the surface. In a preferred embodiment, the pH is below 4.5; preferably below 4.0; more preferably below 3.5; and not below pH 2.

Preferably, the composition according to the present invention is used for the prevention or removal of insoluble salts in toilet, sanitary, bathroom, laundry and automatic dishwashing machine, boiler, kettle, coffee-maker, dairy equipment, food and beverage processing equipment, industrial water systems and wells, concrete removers and the like. However, the composition is also suitable for other descaling activities known by the person skilled in the art.

The second object is achieved by a toilet block a composition comprising itaconic acid, its anhydride and or lactide and combinations thereof.

Such a product shows a higher descaling activity than the products known in the state of the art.

The invention further relates to an effervescent tablet comprising a composition comprising itaconic acid, its anhydride and or lactide and combinations thereof.

Such an effervescent tablet can be used for descaling in several applications, such as a toilet or a dishwashing machine, or any other application known by the person skilled in the art. The solid character of lactide and itaconic acid offers a substantial advantage in the formulation of these tablets. However, these tablets will still be able to dissolve quickly upon contact with water. Also, the fact that the acids used in the composition according to the present invention are so efficient upon prolonged contact, offers a huge advantage for the different applications making use of this effervescent tablet.

This invention also relates to a composition comprising itaconic acid, its anhydride and or lactide and combinations thereof for the prevention or removal of insoluble salt deposits.

The present invention uses a composition comprising itaconic acid, its anhydride, succinic acid or its anhydride and or lactide and combinations thereof, for the prevention or removal of insoluble salt deposits.

The invention is further illustrated and described in more detail in the description and examples given below.

DETAILED DESCRIPTION OF THE INVENTION

All of the organic acids shown in table 1 were tested in order to find a renewable acid that had potential as a descaling agent, both in terms of fast descaling and descaling upon prolonged contact. Furthermore, it was important that the potential descaling agent had a neutral smell, was non-corrosive, and had a solid structure.

When screening various non-corrosive and non-pungent smell acids for their applicability in descaling products, the inventors surprisingly found a substantially different ranking in acid descaling performance for short as compared to prolonged exposure.

As described here above, using non-corrosive acids with a non-pungent or even neutral smell offers clear advantages in the production and use phase, but this fact reduces table 1 to 10, respectively 7 potential candidates. Selecting non-corrosive, non-pungent smell acids obtained from fermentation narrows the selection down to 6, 5 of which are solid state acids, which allows more flexibility in formulating either a liquid end product, a powder or a tablet. This selection is as follows; tartaric, citric, lactic, succinic and itaconic acid as well as lactide, succinic acid and itaconic acid being the subject of the present invention and offering clear advantages over all other acids as illustrated in the description of the invention. In contrast with citric, gluconic and lactic acid, itaconic acid is used exclusively in non-food applications. The recently increased commercial availability of itaconic acid and lactide make this invention all the more attractive.

When a substantial limescale deposit is attacked by a polybasic carboxylic acid is it reasonable to assume that provided the deposit "survives" this acid attack i.e. is thick enough to last for several hours, the calcium concentration at its surface will be high enough as to allow the formation of disalts (or trisalts in the case of citric and phosphoric acid) and the contact time long enough for these often insoluble salts to deposit on the surface, thus forming a greasy layer. Without wanting to be bound by theory the inventors assume this layer slows down further descaling due to inhibited access to the calcium carbonate underneath. From this and from table 1 one would expect that although non-corrosive and having a neutral smell, tartaric, citric and succinic acid will be less suited for the job due to the insolubility of their calcium disalts, whereas glycolic and lactic should be better suited. This proved not to be correct.

Among the acids that were tested, all featuring the aforementioned desirable properties, glycolic acid is very efficient in fast descaling but is far less efficient in prolonged descaling (in example 4, even more or less failing in example 2). This is attributed to the observed formation of a greasy layer (as is the case with tartaric and citric acid), but is in contradiction to what one would expect from the high water solubility of the calcium salt (table 1) and in contradiction to what its manufacturer claims. Lactic acid does a mediocre job in fast descaling, but is second best upon prolonged contact. Succinic acid performs reasonably well in both fast and prolonged descaling, although its calcium salts are insoluble. The inventors furthermore surprisingly found itaconic acid, although not as yet described as such in patent literature, to be the best solid acid in fast descaling as well as upon prolonged contact. Likewise lactide, known to fully hydrolyze into lactic acid, was shown to be very effective against limescale, which was never described before.

Thus the inventors selected two non-corrosive neutral-smell ingredients, which moreover are fully renewable and are solid state ingredients, allowing polyvalent use; itaconic acid, its anhydride and lactide can be used as such in waterless solid compositions or, in case of itaconic acid, used as a liquid compositions, either alone or in combination with other acids. These products are particularly well suited for heavy duty removal for insoluble salt deposits, i.e. requiring prolonged exposure for complete removal.

Stable effervescent toilet descaling tablets containing substantial amounts of itaconic acid were formulated and shown to be very effective. Preliminary tests showed lactide-itaconic based tablets to be even more effective, but present the challenge of gelling due to the high hygroscopy of lactide. As it happens this property is very beneficial in formulating toilet rim blocks by extrusion where it will cause an outer layer or membrane that slows down the overall solubility of the block thereby imparting a controlled release of the fragrance and the surfactant in the block. Moreover the melting point of lactide is anticipated to assist in the extrusion process and cause it to function as a solubility retarder. Finally of course it will act as a slow release agent of lactic acid shown to be very effective in removing lime scale.

These advantages can be complemented with the excellent limescale removing capacity of itaconic acid, which is sufficiently but substantially less water soluble than most other acids, a property which again is a benefit in retarding the complete dissolution of the toilet rim block. Using itaconic anhydride which slowly releases acid upon contact with water, may present further benefits in that its melting point is 67-69°, well within the extrusion temperature range, as opposed to succinic anhydride (120° C.), maleic (53° C.) and glutaric anhydride (47-57° C.).

As said here above, the present invention entails solid and liquid toilet rim blocks. Other products for removing insoluble salt deposits according to the present invention include solid in-cistern blocks, urinal blocks, effervescent toilet tablets, toilet gels, bathroom cleaners, liquids removing limescale from hard surfaces, periodic cleaners for automatic dishwashing and laundry machines, boiler cleaners, treatment products for water wells, boiler systems and tubing, cleaners for dairy and food equipment, concrete cleaners and removers.

The present invention, in various forms or shapes, is shown to be much more effective than the commonly used citric acid for preventing and removing insoluble salts (e.g. Ca, Mg, limescale) while having neutral odor and color, being non fuming, free of phosphorus, non corrosive to the skin, non toxic to aquatic life and obtained by fermentation as a fully renewable product. Moreover it is non corrosive to the treated surfaces among others since it's free of chlorides, thus not representing the risk of possible chloride cracking of stainless steel or embrittlement sometimes experienced in acid chloride systems, nor will it cause spallation (in case of itaconic based formulations).

In order to find a renewable and highly efficient descaling agent according to the present invention, the inventors screened various acids from Table 1 for their potential application as descaling agents.

EXAMPLES

Example 1

Tartaric (Sigma-Aldrich), malic (Sigma-Aldrich), glycolic (Dupont Chemicals), itaconic (Alfa Caesar), lactic (Purac), succinic (Sigma-Aldrich) and citric (Brenntag) acid were tested according to the protocol found in the article "Empfelungen zur Qualitätsbewertung fur saure WC-reiniger" (Qualitatsempfelung des Industrieverbandes Korperpflege- und Washmittel e.V. (IKW), Referat Putz-und Pflegemittel, Frankfurt a.M., paragraph 6 Gebrauchswertprüfung. SÖFW-journal, 120, Jahrgang 13:94) for their descaling efficiency upon short exposure.

For each product, five oven-dry marble plates (Carrara marble, 75×150×5 mm, bought at Van Houten Malle) are weighted on a high precision balance and subsequently completely immersed during 10 seconds in a glass beaker holding 950 milliliter of a 5% active matter acid solution. The plates are then removed from the liquor, and put in upright position for 10 minutes during which the acid is allowed for further action. The plates are subsequently rinsed-off during 30s with softened tap water, dried at 105° C., allowed to cool in a desiccator and again weighted. The weight loss due to the exposure to the acid is used as a measure for its descaling performance. The 0.14766 gram weight loss due to the exposure to the itaconic acid is used as a measure for its descaling performance.

| Product | Plate | Weight (g) Before | After | Difference | | |
|---|---|---|---|---|---|---|
| Itaconic acid | 1 | 154.7922 | 154.6747 | 0.1175 | Average (g) | 0.14766 |
| | 2 | 149.244 | 149.1075 | 0.1365 | standard deviation | 0.029775 |
| | 3 | 151.8382 | 151.6805 | 0.1577 | variation coefficient (%) | 4.959201 |
| | 4 | 150.6909 | 150.4966 | 0.1943 | | |
| | 5 | 153.6839 | 153.5516 | 0.1323 | | |

The same approach was simultaneously followed for the other acids. Finally the average descaling efficiency, the standard deviation and variation coefficient was calculated for all other acids leading to the following comparative table:

| Acid | Average weight loss (g) | standard deviation | variation coefficient (%) |
|---|---|---|---|
| Tartaric acid | 0.09632 | 0.035235 | 2.733622 |
| Malic acid | 0.14574 | 0.029364 | 4.963268 |
| Glycolic acid | 0.16294 | 0.01914 | 8.512848 |
| Itaconic acid | 0.14766 | 0.029775 | 4.959201 |
| Lactic acid | 0.12784 | 0.00771 | 16.58122 |
| Succinic acid | 0.13764 | 0.063322 | 2.173656 |
| Citric acid | 0.10496 | 0.013478 | 7.787259 |

From this table it follows that tartaric and citric acid are not particularly well suited for fast descaling, whereas glycolic is performing best, as claimed by its manufacturer. Itaconic acid outperforms all tested solid acids and all acids obtained from fermentation.

Example 2

Similar to example 1 the descaling efficiency upon prolonged contact to the same range of acids is determined. This is done in duplicate with fully immersed marble blocks ((Carrara marble, 20×30×30 mm, bought at Van Houten Malle) according to the modified protocol of "Qualitätsnormen für saure WC-reiniger" (Qualitätsnormen des Industrieverbandes Putz- and Pflegemittel e.V. (IPP), Frankfurt/M (Fassung 1987)), again monitoring weight loss but this time after 24 hours immersion in the acid solution, followed by rinse-off and drying.

| Acid | Average weight loss (g) |
|---|---|
| Tartaric acid | 0.3141 |
| Malic acid | 8.73535 |
| Glycolic acid | 2.62915 |
| Itaconic acid | 9.6414 |
| Lactic acid | 9.05985 |
| Succinic acid | 9.30385 |
| Citric acid | 3.8461 |

Tartaric acid fails again, but this time glycolic and citric acid underperform as well. The other tested acids are more or less equivalent, but again itaconic acid is performing best among the tested solid acids, in fact best of all the tested acids. The marble blocks exposed to tartaric and citric acid, but also albeit to a lesser extent that exposed to glycolic acid were observed to be covered with a greasy layer, assumed to be water insoluble calcium salts of the acid.

Example 3

The experiments of example 1 and 2 were repeated with the same set of blocks and plates for itaconic acid (5%), lactide (3%), lactide (5%), citric acid (5%) and succinic acid (5%). Solutions were allowed to stand until complete dissolution of the lactide before the descaling test was started.

The following results were obtained for short contact time descaling of plates and prolonged contact descaling of blocks (average values and 95% confidence intervals):

| Descaling agent | Weight difference plates (g) | Weight difference plates (g) −95% | Weight difference plates (g) +95% | Weight difference blocks (g) | Weight difference blocks (g) −95% | Weight difference blocks (g) +95% |
|---|---|---|---|---|---|---|
| Itaconic acid 5% | 0.1115 | 0.088464 | 0.134616 | 7.1586 | 6.2838 | 8.0334 |
| Lactide 5% | 0.1365 | 0.100986 | 0.171974 | 6.0445 | 5.4793 | 6.6097 |
| Lactide 3% | 0.1129 | 0.082268 | 0.143572 | 2.9844 | 2.1723 | 3.7964 |
| Citric acid 5% | 0.0782 | 0.059637 | 0.096683 | 3.3186 | 2.7113 | 3.9259 |
| Succinic acid 5% | 0.0899 | 0.060463 | 0.119297 | 7.2479 | 6.6405 | 7.8552 |

Lactide and itaconic acid again prove to be very efficient descaling agents as compared to citric acid both in fast and prolonged exposure conditions, 3% lactide thereby matching the performance of 5% citric acid. As in example 2, succinic acid performs very well upon prolonged exposure, somewhat less so at short exposures.

Example 4

A non factorial, central composite design experiment was set up, combining citric acid, succinic acid, lactic acid, itaconic acid and glycolic acid and testing the descaling efficiency of the mixtures both at short contact times (on marble plates, protocol as in ex.1) and prolonged contact (on marble blocks, as in ex.2). The required volumes for filling the beakers were prepared as 3% active matter solutions, 20 hours prior to the test. Also the formation of an insoluble layer surrounding the blocks was monitored, scoring no visible layer with a score of 0 and a clearly distinctive layer with a score of 1. The experimental setup and descaling results were as follows (sorted on the visual presence of an insoluble layer):

| citric acid | succinic acid | lactic acid | itaconic acid | glycolic acid | Weight loss plates (g) | Weight loss blocks (g) | Presence of layer |
|---|---|---|---|---|---|---|---|
| 0 | 0 | 0 | 3 | 0 | 0.10074 | 5.41945 | 0 |
| 0 | 3 | 3 | 0 | 3 | 0.19384 | 16.7526 | 0 |
| 0 | 0 | 3 | 3 | 3 | 0.18188 | 15.313051 | 0 |
| 0 | 3 | 3 | 3 | 0 | 0.12942 | 13.6005 | 0 |
| 3 | 0 | 3 | 0 | 3 | 0.17068 | 13.381 | 0 |
| 0 | 3 | 0 | 0 | 0 | 0.08734 | 4.705 | 0 |
| 0 | 0 | 3 | 0 | 0 | 0.09616 | 5.2176 | 0 |
| 3 | 3 | 3 | 3 | 3 | 0.26504 | 19.6414 | 0 |

-continued

| citric acid | succinic acid | lactic acid | itaconic acid | glycolic acid | Weight loss plates (g) | Weight loss blocks (g) | Presence of layer |
|---|---|---|---|---|---|---|---|
| 0 | 3 | 0 | 3 | 3 | 0.19244 | 10.1536 | 1 |
| 1.5 | 1.5 | 1.5 | 1.5 | 1.5 | 0.13584 | 10.4738 | 1 |
| 1.5 | 1.5 | 1.5 | 1.5 | 1.5 | 0.1304 | 9.784 | 1 |
| 3 | 0 | 0 | 3 | 3 | 0.13424 | 12.7577 | 1 |
| 3 | 3 | 0 | 3 | 0 | 0.16276 | 6.7325 | 1 |
| 3 | 3 | 3 | 0 | 0 | 0.1333 | 9.3773 | 1 |
| 3 | 0 | 3 | 3 | 0 | 0.14288 | 13.0694 | 1 |
| 3 | 3 | 0 | 0 | 3 | 0.1672 | 10.8451 | 1 |
| 3 | 0 | 0 | 0 | 0 | 0.05778 | 2.2648 | 1 |
| 0 | 0 | 0 | 0 | 3 | 0.11152 | 4.2873 | 1 |

These data were examined using statistical software Statistica (Statsoft, Statistica version 9).

For the short exposure of the plates the following multiple regression model with a correlation coefficient (adjusted $R^2$) of 0.902 was obtained:

| | Regressn Coeff. | Std. Err. | P |
|---|---|---|---|
| Mean/Interc. | 0.042892 | 0.010743 | 0.003146 |
| (1)citric acid | 0.003786 | 0.003936 | 0.361202 |
| (2)succinic acid | 0.013192 | 0.005328 | 0.035219 |
| (3)lactic acid | 0.014675 | 0.004718 | 0.012515 |
| (4)itaconic acid | 0.013405 | 0.002841 | 0.00109 |
| (5)glycolic acid | 0.015795 | 0.004718 | 0.008556 |
| 1 by 2 | 0.002217 | 0.001894 | 0.271693 |
| 2 by 3 | −0.00293 | 0.001894 | 0.155759 |
| 2 by 5 | 0.002077 | 0.001894 | 0.301121 |
| 3 by 5 | 0.002299 | 0.001894 | 0.255727 |

Succinic, lactic, itaconic and glycolic acid seem to be equally effective at descaling, contrary to citric acid which is ineffective as already illustrated in Ex.1. No significant interactions amongst the acids (synergy or antagonism) were noted.

For the prolonged exposure of the blocks the following multiple regression model for the descaling efficiency was obtained with an correlation coefficient (adjusted $R^2$) of 0.994:

| | Regressn Coeff. | Std. Err. | P |
|---|---|---|---|
| Mean/Interc. | 0.317877 | 0.354173 | 0.46416 |
| (1)citric acid | 0.645604 | 0.132453 | 0.039607 |
| (2)succinic acid | 1.459004 | 0.132453 | 0.008141 |
| (3)lactic acid | 1.629871 | 0.132453 | 0.006539 |
| (4)itaconic acid | 1.697154 | 0.132453 | 0.006036 |
| (5)glycolic acid | 1.319771 | 0.132453 | 0.009923 |

-continued

| | Regressn Coeff. | Std. Err. | P |
|---|---|---|---|
| 1 by 2 | −0.27364 | 0.03949 | 0.020198 |
| 1 by 3 | −0.09582 | 0.03949 | 0.136041 |
| 1 by 4 | 0.078019 | 0.03949 | 0.186854 |
| 1 by 5 | 0.211589 | 0.03949 | 0.033112 |
| 2 by 3 | 0.130106 | 0.03949 | 0.081079 |
| 2 by 4 | −0.36003 | 0.03949 | 0.011818 |
| 2 by 5 | 0.089156 | 0.03949 | 0.152536 |
| 3 by 4 | 0.1093 | 0.03949 | 0.109508 |
| 3 by 5 | 0.136147 | 0.03949 | 0.074812 |
| 4 by 5 | −0.12937 | 0.03949 | 0.081891 |

All acids significantly contribute to descaling, albeit that the effect of citric acid again is only half or less that of the other acids. Itaconic acid performs best as in example 2. Succinic acid combined with citric or itaconic seems to worsen the descaling, whereas glycolic acid positively interacts with citric acid.

In the latter experiment with the blocks the formation of an insoluble layer around the blocks after 24 hours exposure was scored 0 for no appreciable deposit and 1 for a clearly distinctive layer. The following multiple regression model with an correlation coefficient (adjusted $R^2$) of 0.83 was obtained for the formation of an insoluble layer:

| | Regressn Coeff. | Std. Err. | P |
|---|---|---|---|
| Mean/Interc. | 0.055556 | 0.148032 | 0.71528 |
| (1)citric acid | 0.333333 | 0.04969 | 0.000053 |
| (2)succinic acid | 0 | 0.035136 | 1 |
| (3)lactic acid | 0 | 0.04969 | 1 |
| (4)itaconic acid | 0 | 0.035136 | 1 |
| (5)glycolic acid | 0.333333 | 0.060858 | 0.00027 |
| 1 by 5 | −0.11111 | 0.023424 | 0.000788 |
| 3 by 5 | −0.11111 | 0.023424 | 0.000788 |

Citric acid alone and 8 out of 10 of the citric acid containing combinations result in a distinctive separate layer, as opposed to 4 out of 10 for lactic acid and 5 out of 10 for the other acids. Itaconic acid on the other hand does not cause an insoluble layer to be formed and nor do succinic and lactic acid. Contrary to the claims of its manufacturer, and contrary to what one might expect from the solubility of its calcium salts, glycolic acid also caused an insoluble layer on itself and in combinations with other acids, unless it is combined with lactic acid. The model further identifies a significant negative interaction of citric and glycolic acid, which in this case implies a desirable effect, i.e. less insoluble layer when combining glycolic acid with citric acid, probably causing the significant descaling synergy described above.

Example 5

Effervescent 35 gram tablets F1-F8 with the followed compositions were tableted at press forces of 2-5 ton.

| Ingredient | Supplier | F1 | F2 | F3 | F4 | F5 | F6 | F7 | F8 | F43 | F444 |
|---|---|---|---|---|---|---|---|---|---|---|---|
| citric anhydrous | | 80 | 57 | 10 | 10 | 56 | 0 | 10 | 56 | 56 | 41 |
| Itaconic acid | | 0 | 20 | 67 | 50 | 20 | 74 | 58.35 | 20 | 20 | 35 |
| Lactide (Galacid LDPW L50) | Galactic | 0 | 0 | 0 | 17 | 0 | 0 | 0 | 0 | 0 | 0 |
| FAS (Sulfopon 12 G) | Cognis | 5 | 5 | 5 | 5 | 5 | 5 | 5 | 5 | 5 | 5 |
| APG (Glucopon 215) | Cognis | 0.25 | 0.25 | 0.25 | 0.25 | 0 | 0 | 0.25 | 0.25 | 0 | 0 |
| Desintegration aid | | 2 | 2 | 2 | 2 | 2 | 2 | 2 | 2 | 2 | 2 |
| Tabletting aid | | 2 | 2 | 2 | 2 | 2.25 | 1.25 | 2 | 2 | 3.25 | 3.25 |

-continued

| Ingredient | Supplier | F1 | F2 | F3 | F4 | F5 | F6 | F7 | F8 | F43 | F444 |
|---|---|---|---|---|---|---|---|---|---|---|---|
| Sodium carbonate | | 11.35 | 11.35 | 11.35 | 11.35 | 11.35 | 15.35 | 0 | 11.35 | 6.35 | 11.35 |
| Sodium bicarbonate | | 0 | 0 | 0 | 0 | 0 | 0 | 20 | 0 | 5 | 0 |
| Sodium percarbonate | | 2 | 2 | 2 | 2 | 2 | 2 | 2 | 0 | 2 | 2 |
| Potassium persulfate | FMC | 0 | 0 | 0 | 0 | 0 | 0 | 0 | 2 | 0 | 0 |
| perfume pine | | 0.4 | 0.4 | 0.4 | 0.4 | 0.4 | 0.4 | 0.4 | 0.4 | 0.4 | 0.4 |
| Friability (%) | | 94 | 96 | 99 | 98 | 97 | 97 | 95 | 95 | 98 | 98 |
| Desintegration time (s) after 4 ww climate | | 11 | 12 | 4 | 19 | 10 | 5 | '/ | 19 | >20 | 10 |
| Vol. exp. (%) 4 ww climate | | 4 | 1 | 24 | −1 | 5 | 35 | '/ | 3 | 8 | 2 |
| Vol % 8 ww climate | | 5 | 32 | 50 | Wet sticky | 7 | / | Tab strength insuffic | 13 | 10 | 2 |

High concentrations of itaconic acid seem to negatively influence tabletting characteristics, in particular the volume expansion upon climate chamber storage tests, but it is possible to formulate a stable product (e.g. F5, F444) with at least 20% itaconic (e.g. F5) or at least 35% itaconic acid (e.g. F444). Lactide-itaconic based tablets present the additional challenge of gelling, probably due to the high hygroscopy of lactide. Using itaconic anhydride may further improve stability.

These 35 gram tablets were tested for their long exposure descaling efficiency as in example 2 but dosing one tablet per liter. They were compared with 2 market reference tablets, reference 1 being based on sulfamic acid (31 g tablet) and reference 2, a 25 gram tablet, both adjusted to 35 grams for testing the descaling at equal dosage.

| | |
|---|---|
| F1 (35 g): 80% citric acid | 0.2415 |
| F2 (35 g): 57% citric acid + 20% itaconic T | 0.4084 |
| F3 (35 g): 10% citric acid + 67% itaconic | 0.7367 |
| F4 (35 g): 10% citric acid + 50% itaconic + 17% lactide | 0.9614 |
| F6 (35 g): 74% itaconic | 1.13 |

-continued

| | |
|---|---|
| Market reference product 1 (35 g) | 1.0269 |
| Market reference product 2 (35 g) | 0.6621 |

These examples clearly demonstrate the descaling superiority over citric acid of itaconic acid and lactide and in particular of their combination. Using itaconic acid and or lactide allows to match the performance of the market reference products while refraining from corrosive or environmentally hazardous ingredients.

Example 6

Toilet rim block formulations "Rim1" and "Rim2" are taken for reference from the Unger guideline recipes for extrusion of 40 gram rim blocks at 70-90° C. In formulas Rim3 to 8 the solubility retarding coconut MEA and FAEO are replaced by sucrose esters with a comparable melting point and with lactide (which has a somewhat higher mp) or itaconic anhydride (with a comparable melting point). In addition to the acid releasing itaconic anhydride and lactide, itaconic acid is formulated in Rim4 and Rim8 against limescale (similar to the best descaling effervescent tablet of the previous example). Furthermore polysuccinimide and persulfate bleach or calcium peroxide slow release bleach are added to Rim3 and Rim8.

| Ingredient | Ingredient | Supplier | Function | Rim 1 | Rim 2 | Rim 3 | Rim 4 | Rim 5 | Rim 6 | Rim 7 | Rim 8 |
|---|---|---|---|---|---|---|---|---|---|---|---|
| FAS 1218 | UFAROL TCT 90 P | Unger | Extrusion aid and improved soft water foaming (mp >200° C.) | 31.5 | 24 | 31.5 | 24 | 24 | 24 | 24 | 24 |
| AOS | Ufapore TCO | Unger | Dry foam booster | | 1.5 | | 1.5 | 1.5 | 1.5 | 1.5 | 1.5 |
| FAEO (*) | TP716 | Unger | Combined extrusion aid and solubility retarder | | 16 | | 16 | | | | |
| FAEO | Emulgator F8 | Unger | Surface finish improver and extrusion aid | | 0.5 | | 0.5 | 0.5 | | | 0.5 |
| Sodium Chloride | / | / | Filler for increased block hardness | 12.5 | | 12.5 | | 12.5 | 12.5 | 12.5 | 7.5 |
| Sodium Sulphate | / | / | Filler | 49.25 | 49 | 39.5 | 35 | 42.5 | 42.5 | 42.5 | 35.5 |
| Calcium carbonate | / | / | Filler - Compactation agent | | 1 | | | | | | |
| LES70 | Foam enhancer | Unger | Liquid foam booster | 0.5 | | 0.5 | | | | | |

-continued

| Ingredient | Ingredient | Supplier | Function | Rim 1 | Rim 2 | Rim 3 | Rim 4 | Rim 5 | Rim 6 | Rim 7 | Rim 8 |
|---|---|---|---|---|---|---|---|---|---|---|---|
| Pine fragrance | Pine fragrance | / | Fragrance | 3 | 3 | 3 | 3 | 3 | 3 | 3 | 3 |
| Coconut MEA | Ufanon MK Eur-amid FMCM/FL | Unger EOC Surfac-tants | Solubility retarding mp 75° C. | 3.25 | | | | | | | |
| Polysucinimid | Baypure DSP grinded | Lanxess | Hydrolyses to lime dis-persing agent | | | 4 | | | | | |
| Calcium Peroxide | Ixper 75C | Solvay | Slow release bleach | | | 4 | | | | | |
| K-persulfate | / | FMC | Bleach | | | | | | | | 4 |
| Sodium citrate | | | Complexing agent | | 5 | | | | | | |
| Itaconic anhydride (*) | | | Slow release descaler, solubility retarding (hygroscopic and mp 67-69° C.) | | | | 20 | | | | |
| Itaconic acid | | | Descaling agent | | | | | | | | 10 |
| Lactide (*) | | | Slow release descaler, solubility retarding (hygroscopic and mp 94-99° C.) | | | 5 | | 16 | 16 | 16 | 16 |
| sucrose behenate | Sefose 2275C | PG Chemicals | Solubility retarding mp 65° C. | | | | | | 0.5 | | |
| sucrose stearate | Sefose 1618H | PG Chemicals | Solubility retarding mp 71° C. | | | | | | | 0.5 | |

(*) Cooling of the extruder head will be necessary when using high amounts of coconut MEA, TP 716, itaconic anhydride or lactide to maintain pressure in the extruder and avoid the block becoming too soft for cutting. Recipe adjustments due to local variations in requirements and extruder properties will have to be considered.

Example 7

| Composition | Trial 1 | Trial 2 | Trial 3 | Trial 4 | Trial 5 |
|---|---|---|---|---|---|
| Fatty alcohol sulphate 1218 | 37 | 30 | 30 | 30 | 30 |
| Sucrose ester from fatty acid, melting point 65° C. | 10 | 5 | 5 | 5 | 5 |
| Itaconic acid | 5 | 5 | 5 | 5 | 5 |
| Slow release Lactide | 2.7 | 2.7 | 2.7 | 7.5 | 2.7 |
| Persulfate | 0 | 0 | 0 | 0 | 10 |
| Water | 1.3 | 1.3 | 1.3 | 1.3 | 0.5 |
| NaCl | 16 | 16 | 16 | 16 | 16 |
| Sulfate | 25 | 36 | 36 | 31.2 | 25.5 |
| Fragrance | 3 | 4 | 4 | 4 | 5.3 |
| Total | 100 | 100 | 100 | 100 | 100 |
| Diameter (mm) | 42 | 42 | 25 | 25 | 25 |

Tablets produced by extrusion of the compositions listed in Example 7 (Trials 1 to 5) provided hard tablets of consistent composition and homogeneous and consistent appearance. These tablets lasted well above 50 flushes. Tablets made according to the above described compositions wherein the slow-release lactide was replaced by standard lactide showed needle like protrusions, probably caused by lactide crystals.

Example 8

Formulation for dishwashing machine, in analogy with a commercial dishwashing machine composition sold under the brand name Finish, comprises:

85% itaconic acid (replacing citric acid),

10% low foaming non-ionic surfactant, 0.5% fragrance and 4.5% additives, such as phosphonates and/or calcium silicate Suitable surfactants for use in the above formulation are PPG-15 C12-18 and PPG-5 Laureth-5 with fatty alcohol alkoxylate By the term low foaming as described herein it is meant, producing no foam or a foam which disappears after build up within less than 5 minutes.

Example 9

Formulation comprising itaconic acid and between 1-20% of slow-release lactide, in the form of powder or a 30% solution, for the treatment of insoluble salt deposits in expresso machines.

What is claimed is:

1. Composition in the form of a toilet rim, cistern or urinal block, or in the form of a tablet for the prevention or removal of insoluble salt deposits comprising:

a) an organic acid with two carboxylic acid functional groups obtainable by fermentation, selected from the group consisting of itaconic acid, itaconic acid anhydride, and combinations thereof, wherein itaconic acid has a water content of at most 5%, and b) at least one compound determining the release of said acid from said composition, wherein said compound is:

i) a hygroscopic compound.

2. Composition according to claim 1, wherein the organic acid is itaconic acid.

3. Composition according to claim 1, wherein i) the hygroscopic compound is lactide, an anionic surfactant, such alkyl benzene sulfonate, or combinations thereof.

4. Composition according to claim 3, wherein at least part or all of the alkyl benzene sulfonate in the composition is replaced by fatty alcohol sulfate.

5. Composition according to claim 1, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

6. Composition according to claim 1, wherein the composition is a toilet rim, cistern or urinal block, comprising:

3-30 weight % itaconic acid, itaconic anhydride or a combination thereof, 20-50 weight % linear alkyl benzene sulfonate and/or fatty alcohol sulfate, and the remainder formulation auxiliaries.

7. Block comprising the composition according to claim 6, comprising an acid solubility retarding sucrose derivative such as a sucrose behenate, sucrose stearate and/or a fatty acid derived sucrose ester with melting point between 60° C.-75° C.

8. Block comprising the composition according to claim 6, with a life expectancy of at least 50 flushes, preferably at least 100 flushes, most preferably at least 200 flushes.

9. A method for the prevention or removal of lime scale, beer stone, milk stone, barium sulfate, calcium oxalate and combinations thereof comprising applying the composition of claim 1 to a surface comprising lime scale, beer stone, milk stone, barium sulfate, calcium oxalate and combinations thereof.

10. The method according to claim 9, wherein the surface is selected from the group consisting of a toilet, a laundry machine, a dishwashing machine, a boiler, a kettle, a coffeemaker, an espresso machine, a dairy equipment, a food processing equipment, a beverage processing equipment, an industrial water system, and a well.

11. Method for manufacturing compositions according to claim 1, for the prevention or removal of insoluble salt deposits comprising the steps of:

selecting an organic acid with two carboxylic acid functional groups obtainable by fermentation and available in substantially dry powder form, from itaconic acid, itaconic acid anhydride or a combination thereof, mixing the selected organic acid with at least one compound determining the release of said acid from said composition, wherein said compound is i) a hygroscopic compound, extruding or melt casting the mixture obtained at a temperature between 60° C.-95° C., obtaining the composition for the prevention or removal of insoluble salt deposits in a desirable form such as a block or tablet.

12. Method for the prevention or removal of insoluble salt deposits comprising the steps of:

connecting a composition according to claim 1 to a supply means of water, contacting the composition with water from said supply means thereby lowering the pH of the water to a pH below 5, leading the water with pH below 5 over a surface in need of treatment, thereby preventing insoluble salts to deposit on the surface or thereby removing from the surface insoluble salts deposited on the surface.

13. Composition according to claim 2, wherein i) the hygroscopic compound is lactide, an anionic surfactant, such alkyl benzene sulfonate, or combinations thereof.

14. Composition according to claim 13, wherein at least part or all of the alkyl benzene sulfonate in the composition is replaced by fatty alcohol sulfate.

15. Composition according to claim 2, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

16. Composition according to claim 3, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

17. Composition according to claim 4, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

18. Composition according to claim 13, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

19. Composition according to claim 14, comprising a slow-release lactide as measurable by the pH-development of a 0.1 w/v % solution of the slow-release lactide in demineralized water at 25° C. and the curve depicting the pH versus time displaying a pH of 3.7 after 5 minutes, 3.2 after 10 and 2.5 after 120 minutes.

* * * * *